US005403130A

United States Patent [19]

Moser et al.

[11] Patent Number: 5,403,130

[45] Date of Patent: Apr. 4, 1995

[54] ROCK DRILL

[75] Inventors: Bernhard Moser, Altshausen; August Haussmann, Ravensburg; Hans-Ulrich Muetschele; Harald Schindler, both of Stuttgart; Hans-Peter Meyen, Filderstadt, all of Germany

[73] Assignees: Hawera Probst GmbH & Co., Ravensburg; Robert Bosch GmbH, Stuttgart, both of Germany

[21] Appl. No.: 143,144

[22] Filed: Oct. 29, 1993

[30] Foreign Application Priority Data

Oct. 29, 1992 [DE] Germany ..... 42 36 553.8

[51] Int. Cl.[6] ..... B23B 51/00; E21B 10/44

[52] U.S. Cl. ..... 408/225; 175/323; 175/394; 408/227

[58] Field of Search ..... 175/323, 394, 385, 398; 408/225, 226, 227, 230, 144

[56] References Cited

U.S. PATENT DOCUMENTS

| | | | |
|---|---|---|---|
| 2,383,212 | 8/1945 | Pohle | 408/226 |
| 4,852,670 | 8/1989 | Peetz et al. | 175/323 |
| 4,924,953 | 5/1990 | Moser | 408/230 |
| 4,942,931 | 7/1990 | Moser | 175/323 |
| 5,265,688 | 11/1993 | Rumpp et al. | 408/230 |

FOREIGN PATENT DOCUMENTS

| | | |
|---|---|---|
| 0347601A1 | 12/1989 | European Pat. Off. . |
| 2756990C2 | 6/1979 | Germany . |
| 2856205 | 7/1980 | Germany . |
| 8104116 U | 6/1982 | Germany . |
| 9002460 U | 5/1990 | Germany . |

*Primary Examiner*—Daniel W. Howell
*Attorney, Agent, or Firm*—Spencer, Frank & Schneider

[57] ABSTRACT

A drilling tool and, in particular, a rock drill for the creation of breaches in concrete or masonry for the use of drill hammers is proposed, which is configured as a cross drill bit having four cutting fins. In order to optimize drilling capacity, the drilling tool is provided with a cross drilling head which merges in one piece into a conveyor spiral matched to the drill head. A purpose-specific cutting element facing serves to optimize the drilling capacity.

19 Claims, 4 Drawing Sheets

ROCK DRILL

BACKGROUND OF THE INVENTION

The invention relates to a rock drill for creation of breaches in concrete or masonry of the type including a drill shank, a conveyor spiral having a run-in region at one end merging with the drill shank and a carbide-tipped drilling head integrally connected with the opposite end of the conveyor spiral which includes radially extending cutting fins and a cavity emerging as a bore dust run-out in the conveyor spiral.

PRIOR ART

Drilling tools for the creation of breaches have become known from EP-0 347 601 A1 (Hawera) together with literary sources which are additionally quoted therein.

In particular from DE-27 56 990 C2 (Krupp) and DE-28 56 205 A1 (HILTI), drilling tools for rock working have become known, in which the radially disposed cutting fins exhibit axially extending, outer cutting fin margins armed with carbide studs, flat indentations being provided between the radially outer cutting fin margins and the centrical centering tip, which indentations are likewise armed with carbide studs. In contrast to the above, the drilling tools according to EP 0 347 601 A1, already mentioned in the introduction, and according to German utility model GM-81 04 116 (Bosch, FIG. 5) are configured on their end face such that they have largely flat cutting fins.

The principle upon which the known drilling tools, in particular for the creation of breaches in concrete or masonry, which are also referred to as breaching drills, are based is that the rock material is fragmented by the impact effect of a heavy drill hammer, the carbide cutters, in a similar fashion to pointed chisels, producing a blasting effect in the brittle material. Insofar as only the radially outer, axially protruding marginal region of the drilling tool according to DE-27 56 990 (Krupp) or DE-28 56 205 (HILTI) is active, the stone material is removed in a pot shape, whereupon the radially inner region, due to the brittleness of the material, likewise breaks away. The axially protruding wall regions lead to an enhanced pointed chisel effect and hence to an enhanced material removal. The axially set-back, inner region of the cutting fins is likewise faced, in the known drilling tools, with carbide studs. These do not however primarily serve the removal of material, but rather serve the crushing of the material already broken away.

A pot-shaped configuration of the drill bit having axially protruding margins admittedly has the advantage of increased surface pressure and hence of increased drilling capacity, since the axially set-back indentations make no or only a minor contribution to the removal of the rock. The circumstance here arises however that the bore dust which has been removed from the axially protruding annular segments and is partially pulverized comes to lie upon the end face of the cutting fins before being carried off, by the discharge openings provided between the cutting fins, into the bore dust grooves or conveyor spiral. This can result in the drilling tool, in these very largely flat, end-face regions of the cutting fins, sitting virtually on a cushion of bore dust, thereby leading to a certain damping of the impact effect and hence to a reduction in the drilling progress. This applies particularly to a relatively large, set-back surface located at the end face, as is shown in the literature already mentioned in the introduction.

The known tools generally exhibit a drilling head, to which no conveyor spiral connected thereto in one piece is adjoined. Instead, according to the representation in EP 0 347 601 A1 (Hawera), additional conveyor spirals which can be mounted onto the smooth drilling shank are used for the transportation of the bore dust. These additional conveyor spirals, particularly made from plastics, are subjected to increased wear and can make no overall contribution, in particular, to the hardening of the drilling tool.

From the Westa company, a drilling tool has become known, the drilling head of which exhibits four cruciformly disposed, radially running cutting fins which are faced with carbide plates. This drill bit is connected in one piece to a double-pitched conveyor spiral, the ends of which on the drill head side run out in an axis-parallel surface of the two opposing cutting fins, so that these two cutting fins are of very ponderous configuration, whilst the two further cutting fins disposed at right-angles thereto are heavily undercut by the respective conveyor spiral.

Furthermore, from the generic type-establishing DE-U 90 02 460 (Drebo), a "crown drill" has become known which exhibits a drilling head having two cutting fins with intermediate bore dust run-outs to a double conveyor spiral connected thereto in one piece. In this case, the respective conveyor spiral run-out ends in the full radial width of the respective cutting fin, so that the drilling head has a very non-symmetrical and ponderous structure and the cutting fins exhibit a very different material support provided by the conveyor spiral.

SUMMARY OF THE INVENTION

It is an object of the invention to overcome the aforementioned drawbacks of the known drilling tools and to otherwise provide an improved drilling tool.

The above and other objects are accomplished in accordance with the invention by the provision of a drilling tool for creation of breaches in concrete or masonry, comprising: a drill shank; a conveyor spiral having a run-in region at one end merging with the drill shank and an end opposite to the one end; and a carbide-tipped drilling head integrally connected with the opposite end of the conveyor spiral and including radially disposed and circumferentially extending cutting fins and a cavity which emerges as a bore dust run-out in the conveyor spiral, wherein a transition between the drilling head and the opposite end of the conveyor spiral exhibits a circumferential constriction so that all cutting fins have a substantially similar longitudinal cross section and the transition is substantially rotationally symmetrical.

The rock drill according to the invention has the advantage in contrast to the above that a drilling tool is created which has been improved and optimized in various respects in relation to the known drilling tools. In particular, a low weight which is acceptable for a one-piece tool is obtained in this case despite a one-part construction, as well as a hard-wearing tool offering simple handling. By virtue of the particular shaping of the drilling head in conjunction with a conveyor spiral which continues on from it in one piece, high drilling capacities, both in the new and in the used states, and hence a long working life are achieved.

The core concept upon which the invention is based is to improve the advantageous properties of a drilling tool of the type designated in the introduction, i.e. of a drill bit as shown for example in DE-28 56 205 A1, DE 27 56 990 C2 or DE-U 90 02 460, such that an increased drilling capacity can be obtained. To this end the invention derives initially from a tool in which the conveyor spiral is connected in one part to the drilling head. The wear upon the drill spiral is thereby reduced and tool lives are therefore considerably improved. However, a drilling head having a conveyor spiral connected thereto in one piece has, first of all, the serious drawback that, due to the run-out of the conveyor spiral into the drilling head, a very ponderous tool is formed in the region of the drilling head. Where the configuration of the individual cutting fins, due to this one-piece construction, is very different, i.e. very asymmetrical, there are produced in the individual cutting fins very different stress ratios, which frequently lead to premature fracturing of the cutting fins. For example, a cutting fin which is supported by a conveyor spiral behaves in its vibration characteristics totally differently from a cutting fin which juts freely out over a conveyor spiral groove. A symmetrical arrangement of the drilling head, as shown, for example, by DE 28 56 205, is not known in which a spiral conveyor is connected in one piece to the drilling head.

The invention comes in here to the effect that a drilling tool having a drilling head is created, in which invention the drilling head, despite being connected in one piece to a conveyor spiral, maintains the most symmetrical and, for example, bell-shaped outer contour possible, as is fundamentally shown in the stated prior art (HILTI), though without a conveyor spiral. This can be achieved, in association with a conveyor spiral which is integrated in one piece, by the fact that the run-out region at that end of the conveyor spiral located on the drill head side and, more specifically, the wall section on the drill head which follows it is shaped such that not only a cylindrical outer contour having the outer diameter of the conveyor spiral in this drill head section, but also a harmonic transition from the conveyor spiral into the drilling head is obtained. This is achieved by a constriction or necking of that region of the drilling head adjoining the run-out of the conveyor spiral. The drilling head is accordingly largely symmetrically rounded in its outer contour or contacting surface and is constructed, in particular, in a bell shape, the run-out of the conveyor spiral being integrated into these regions.

An extremely symmetrical structure of the drilling head with its fins is thereby produced, resulting in almost identical vibration characteristics for each individual fin. Tests have revealed that the tool lives of a drilling tool of this kind are substantially greater, even under elevated load, than in a drill head of which the fins, due to the run-out of a drill spiral, are very differently materially supported. The vibration characteristics of the entire drilling tool are therefore decisively improved, thereby reducing the susceptibility to wear. The drilling tool according to the invention accordingly has the objective of creating the most symmetrical and, in particular, bell-shaped drilling head possible, in which the transition from the conveyor spiral into the drilling head is constructed such that an approximately bell-shaped outer contour of the drilling head is largely maintained. This is achieved by appropriate necking or by concave configurations of that drilling head region which follows on from the run-out of the conveyor spiral. By virtue of these measures, a drilling tool is created which satisfies the highest demands, without any stress peaks and hence a risk of fracturing arising in the drilling head. Equally, the conveyor spiral contributes with its guidance to high drilling capacities and long tool lives.

The objective of the most symmetrical possible structure of the drilling head offering a harmonic transition of the double conveyor spiral has the effect, in the drilling tool according to the invention, that optimal vibration characteristics are created in the drilling tool.

According to an advantageous refinement of the invention, it is envisaged that the transition from the conveyor spiral into the shank region should also, in turn, be realized harmonically without any substantial jumps in cross section, in that an arc-shaped transition of the run-out of the conveyor spiral into the drill shank is provided. By virtue of large radii at the transition of the drill shank into the run-in region of the conveyor spiral, stress peaks are as far as possible avoided in these regions.

In a logical refinement of the invention, it is envisaged that the drill shank as a whole should also exhibit the least possible jumps in cross section which lead to stress peaks. Particularly in relatively large drilling tools having drill diameters of, for example, 65 or 80 mm, the drill shank is substantially thicker in the region of the spiral run-in than at its clamping end. This diametral transition is constructed, in the tool according to the invention, by conical shank regions, there being provided between the conical regions, according to the invention, cylindrical regions on which the drill shank can be clamped easily into a jaw chuck for the purpose of being worked. Consequently, a long drill shank, the length of which can exhibit 300 mm and more, can be connected to the conveyor spiral by means of a friction-welding process or the like. The alignment of the shank can be effected by the clamping of the partly conical shank to the cylindrical shank sections.

Further advantageous designs are specified in the further subclaims.

Particularly advantageous is the configuration of the rock drill, whereby the drilling head exhibits four annular segments interrupted by breaches or recesses, as is fundamentally known from DE 28 56 205 which has three annular segments.

According to the invention, however, the annular segments are configured in their end-face region in a roof-shape or V-shape, so that the cutting stud facing, which is applied obliquely in relation to the longitudinal axis of the drill, can be mounted on the two flanks of the roof-shaped configuration. The impartation of force, at the end face, onto the rock material is thereby optimally realized.

It is advantageous furthermore that, by virtue of the necked-down configuration of the drilling head in the region of the conveyor spiral run-out, weight savings are also achieved, whereby fracture-proofness, because of the avoidance of stress peaks, is increased.

The outer diameter of the drilling head is expediently chosen to be larger than the outer diameter of the conveyor spiral in order to prevent the tool from tilting, an optimal longitudinal guidance nevertheless being maintained.

The conveyor spiral is expediently made only as long as is absolutely necessary to enable the bore dust to be evacuated. Expediently, the length of the conveyor spiral is chosen to be at least twice as large as the drilling head diameter in order to obtain sufficient support for the drilling head and evacuation of the bore dust.

The pot-shaped drilling head exhibits a cutting fin base which, in the cross section in each case between the radially outer marginal segment and the centrically disposed centering tip, is of arc-shaped or circular configuration. This has the advantage that at no place is there any existence of high surface pressure onto flat surfaces.

The arc-shaped or circular base of the cutting fins exhibits, moreover, a cutting stud facing which is known per se and which is disposed, however, on the one hand directly next to a radial recess, on the other hand centrically on a cutting fin. By virtue of these cutting studs and the arrangement on the circular cross sectioned base being radially offset, an optimal bore dust discharge from this set-back, arc-shaped part of the cutting fins is produced. The cavities or recesses present between the annular segments protrude as far as possible into the center of the drilling head in order to transport away the bore dust accumulating there as easily as possible into the bore dust grooves of the conveyor spiral. In the region of the run-out of the conveyor spiral, the recess is obliquely disposed for this purpose so that it leads into the there radially outer conveyor spiral.

Further details of the invention are represented in the drawings and explained in greater detail in the following description, further advantages being therein specified.

DETAILED DESCRIPTION OF THE PREFERRED EMBODIMENT

Figure 1A:
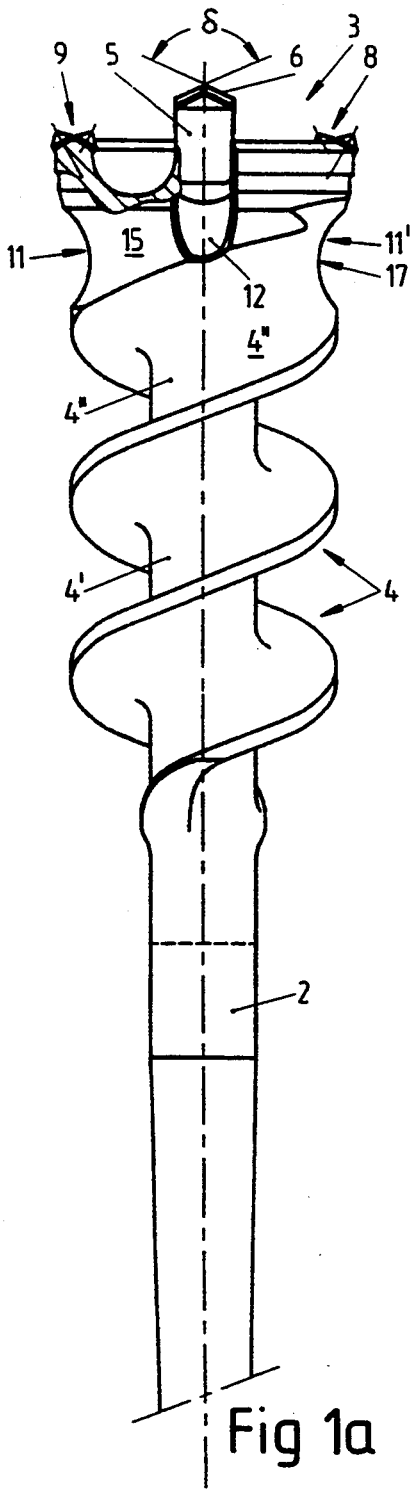
FIG. 1*a* shows a side view (90° rotation) of the drilling tool according to FIG. 1 with a part-section through the drilling head.

The fundamental structure of a drilling tool of the generic type, i.e. of a drill bit for the creation of breaches in concrete or masonry, is explained in greater detail in the literary sources quoted in the introduction. In this regard, reference is made, in particular, to the content of DE 28 56 205 (BILTI).

The drilling tool 1 represented in FIGS. 1, 1*a* in two side views and in FIG. 1*b* in top view comprises a drill shank 2 and a drilling head 3, which is also hereinafter referred to as "cross drilling head". Between the drilling head 3 and the drill shank 2 there is located a conveyor spiral 4, which is connected in one part to the said drill shank and is configured as a double spiral or double-pitched spiral having the spirals 4', 4''.

The drilling head 3 of the drilling tool exhibits a centrical drilling head tip 5, which is armed with a roof-shaped carbide cutting element 6. According to the representation in FIG. 1*b*, the rock drill 1 exhibits, for the formation of a drill bit 4, radially disposed circumferentially extending cutting fins 7 to 10, which are separated or interrupted by cavities or recesses 11, 11' or 12, 12'.

Figure 1:
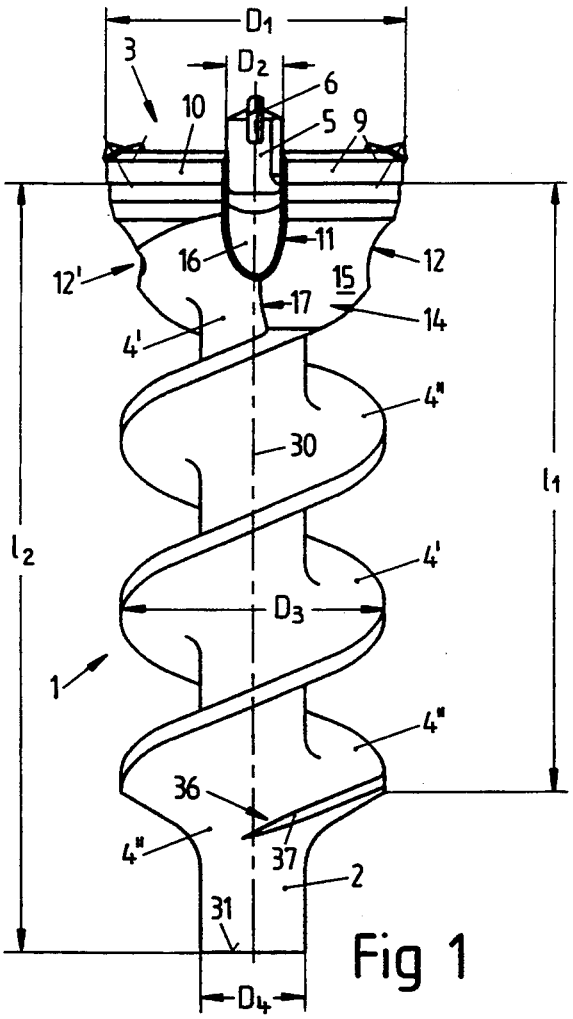
FIG. 1 shows a side view of the drilling tool having a one-part double conveyor spiral.
Figure 1B:
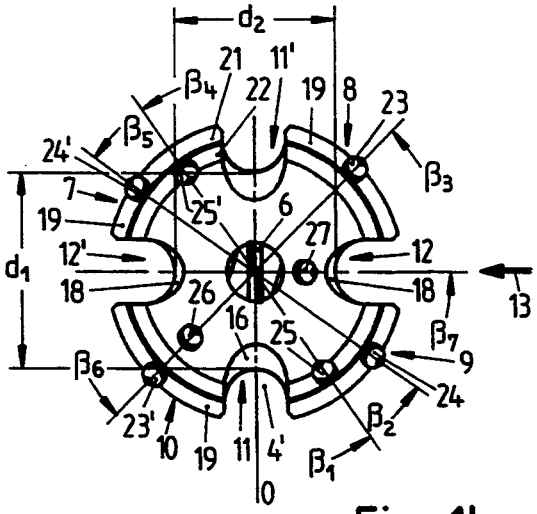
FIG. 1*b* shows a top view of the drilling tool according to FIG. 1, FIGS. 2*a* to 2*c* show an enlarged representation of the drilling head with part-sections.

The representation according to FIG. 1*a* is derived from the side view of FIG. 1 or 1*b*, from the direction of view of the arrow 13 in FIG. 1*b*.

In the representation according to FIG. 1, 1*b*, the first conveyor spiral 4' of a double conveyor spiral 4', 4'' ends in the region of the cavity 11 along the edge 17, that region 14 which follows on from the conveyor spiral 4' materially supporting the above-lying cutting fin 9, as a result of which the said cutting fin is materially strengthened. In contrast to the above, the left cutting fin 10 represented in FIG. 1, 1*b*, due to the below-lying conveyor spiral 4', is not materially supported, so that the drilling head is configured in this region with its outer contour in a V-shape or bell-shape. The fin 10, which is slim in terms of its longitudinal cross section, would consequently be followed by a cutting fin 9 of very large material thickness. The same relationships exist in respect of the two other cutting fins 7, 8.

In order now to lend a symmetrical and uniform structure to the drilling head as a whole and hence lend the most uniform possible longitudinal cross section with as equal as possible wall thicknesses to the individual cutting fins 7 to 10, that cutting fin 9 or 7 following on from the respective drill spiral run-out is subjected to a machine-cutting supplementary treatment, whereby the region 14 which follows on from the spiral run-out (edge 17) acquires a concave constriction or necking 15 which extends across the entire outer contacting surface of the respective cutting fin 9, 7. The initially material-thick region 14 thereby receives a material removal which shapes the outer contour of the drilling head into a substantially rotationally symmetric bell-shaped rounding, as is fundamentally shown in respect of the drilling tool according to DE 28 56 205 (HILTI), though without a conveyor spiral. By virtue of this necking of the region following on from the respective conveyor spiral, a harmonic, rounded transition to the respectively next-following fin or next-following cavity between the fins is achieved. This enables the drill head to be narrowly and ornamentally shaped even in the case of large tools.

Figure 2A:
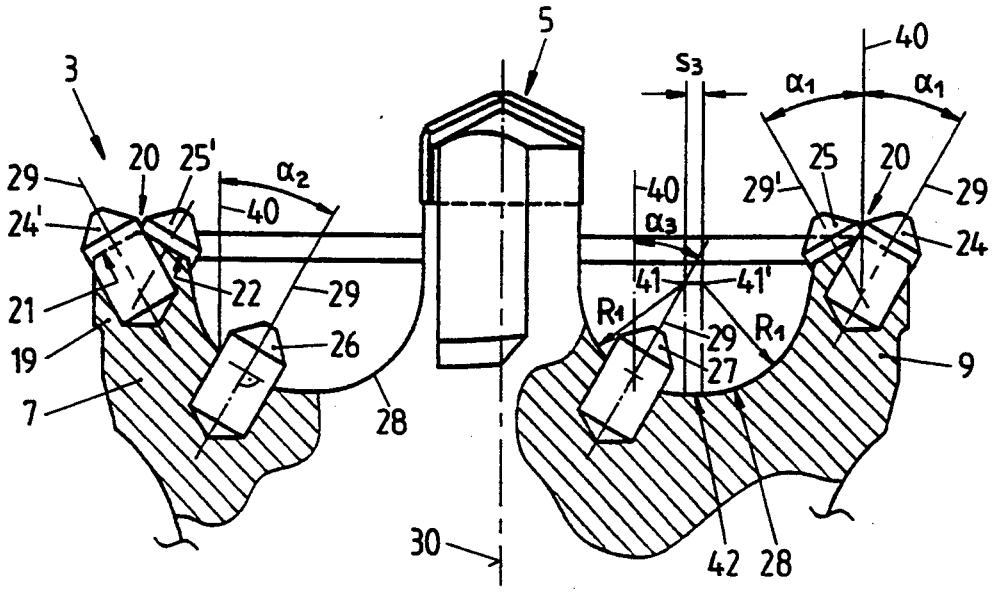
Figure 2B:
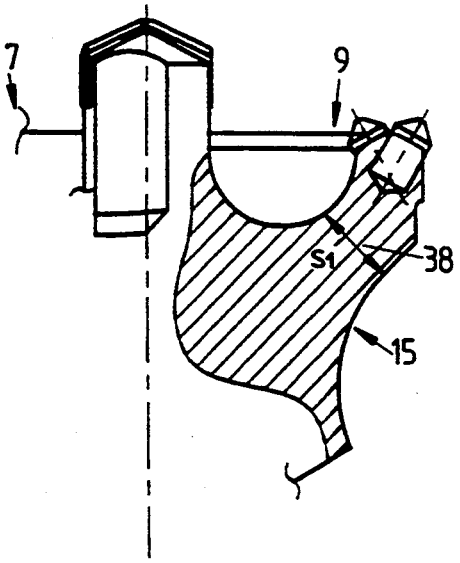
Figure 2C:
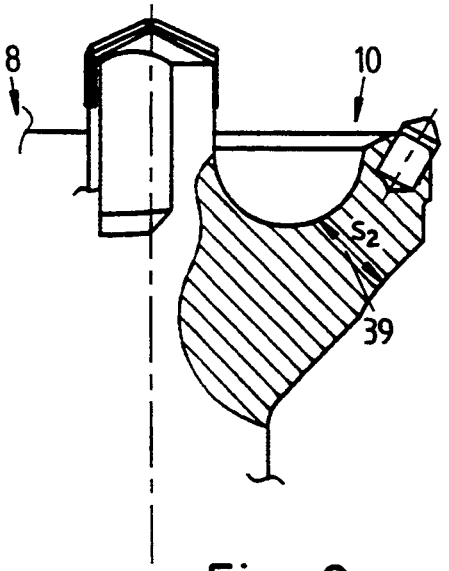

In FIGS. 2*b* and 2*c*, these characteristic cross sectional relationships between the individual fins are shown once again. FIG. 2*b* shows a longitudinal section through the fins 7, 9 with the material support of the conveyor spiral 4', 4'' in the following region 14, the concave constriction 15 resulting in a material cross section 38 which is approximately equally as thick in its wall thickness $s_1$ as the wall thickness $s_2$ of the cross section 39 of the two fins 8, 10 which are situated above the respective conveyor spiral groove 4', 4'', i.e. are not materially supported. The effect of this is that all cutting fins 7 to 10 exhibit approximately the same cross sectional structure and thus bring about the symmetrical structure of the drilling head as a whole.

The cavities 11, 11' in the region of the run-out 17 of he respective conveyor spiral 4', 4'' lie on a larger drill core diameter $d_1$, since his region is substantially thicker than the core diameter $d_2$ in the region of the cavities 12 12'. The cavities 11, 11' consequently have to be guided on an approximately 45°- bevel 16 into the run-out of the respective conveyor spiral 4', 4'' (run=out edge 17). In contrast to the above, the cavities 12, 12' can be guided almost perpendicularly in the respective, below-lying sections of the conveyor spiral 4', 4''. The associated run-out bevel 18 can therefore be kept very steep (see FIG. 1*b*).

From FIGS. 1*a*, 1*b* and, in particular, from FIG. 2*a*, the precise structure of the drilling head 3 according to the invention can be deduced with regard to the cutting facing. Each cutting fin 7 to 10 firstly exhibits in each case, an annular segment 19, which, in its end-face region, is formed as a roof-shaped configuration having a first, outwardly pointing bevel 21 and a second, inwardly pointing bevel 22 the annular segment extending in the direction of the longitudinal axis of the drilling tool. As can be seen from FIG. 1*b*, each annular segment 19 exhibits, at least on its outer bevel 21, at least one cutting element 23, 23' or 24, 24'. In addition the two annular segments 19 of the cutting fins 7, 9 exhibit on the inwardly directed bevel 22, a further cutting element 25, 25 '. Consequently, the two cutting fins 7, 9 exhibit respectively, on their roof-shaped bevels 20, two cutting elements 24, 25 or 24', 25', which are disposed asymmetrically at the angle definitions $\beta$ represented in FIG. 1*b*, the angle $\beta$ commencing at the lower setting in FIG. 1*b* denoted by 0. Equally, the cutting fins 8, 10 exhibit respectively, only on their outer bevel 21, a cutting element 23, 23', which cutting elements are disposed symmetrically on the respective cutting fin. The defined angles $\beta_1$ to $\beta_6$ for the arrangement of the respective cutting elements follow in the steps $\beta_1=35°$ for the cutting element 25, $\beta_2=55°$ for the cutting element 24, $\beta_3=135°$ (cutting element 23 ), $\beta_4=215°$ (cutting element 25'), $\beta_5=235°$ (cutting element 24'), $\beta_6=315°$ (cutting element 23').

As represented in FIG. 2*a*, the pot-shaped configuration of the drilling head 3 to the side of the drilling head tip 5 exhibits, in each case an arc-shaped or semi-circular course, which is designated as a circumferential, arc-shaped base 28. This base exhibits a radius of curvature $R_1$ which, in the case of a drilling tool having a drilling head diameter $D_1=65$ mm, lies in the order of magnitude of $R_1 \approx 8$ to 10 mm. In contrast to the known drill bits, the circumferential base 28 of the cutting fins is accordingly of heavily arched configuration, whereby an axial thrust is constantly generated onto the therein assembled bore dust in order to guide this into the cavities 11, 12.

As can be seen from FIG. 1*b* in conjunction with FIG. 2*a*, the arc-shaped base 28 exhibits, for example in the cutting fin 7 or 10, a further cutting element 26, which is inclined at an angle $\alpha_2 \approx 30°$, relation to an axis-parallel vertical 40, inwards towards the drill axis 30. The center axis 29 of the cutting element 26 thereby forms the surface normal onto the arc-shaped surface 28. The arrangement of the cutting element 26 lies at the same angular distance $\beta_6$ apart as the arrangement of the cutting element 23' on the bevel 21.

In addition to the cutting element 26, the arc-shaped base 28 exhibits a further cutting element 27, which is likewise inclined by an angle $\alpha_3 \approx 30°$, in relation to an axis-parallel 40, in the outward direction. According to the supplementary representation in FIG. 1*b*, this cutting element 27 is disposed radially further inwards than the cutting element 26.

It is located preferably behind the cavity 12, at an angular distance $\beta_7=90°$. The center axis 29 once again forms the surface normal onto the arc-shaped base surface 28 of the drilling head.

The two cutting elements 24, 24' having the center axis 29 and the two cutting elements 25, 25' having the center axis 29' are similarly inclined at an angle $\alpha_1 \approx 30°$ in relation to a vertical 40. Equally, these center axes 29, 29' form the surface normals onto the surfaces 21, 22 of the roof-shaped bevel 20.

From FIG. 2*a*, it can further be seen that the arc-shaped base 28, in drilling tools of relatively large drilling diameter $D_1$, can be configured in the lower region in the shape of a trough, i.e. the midpoints 41, 41' of the radii $R_1$ are laterally separated by an amount $S_3$, thereby producing a corresponding, flat base region 42 of the same width $S_3$.

In FIG. 1*a*, the angle $\delta \approx 120°$ to 130° for the roof-shaped bevel of the carbide cutting element 6 is additionally represented. The diameter $D_2$ of the drilling head tip 5 amounts, in a drilling tool of $D_1=65$ mm, to $D_2$ 12 mm.

The length $l_1$ of the conveyor spiral 4 is dimensioned such that it is at least twice as large as the diameter $D_1$, i.e. $l_1 \geqq 2 \times D_1$.

Figure 3B:
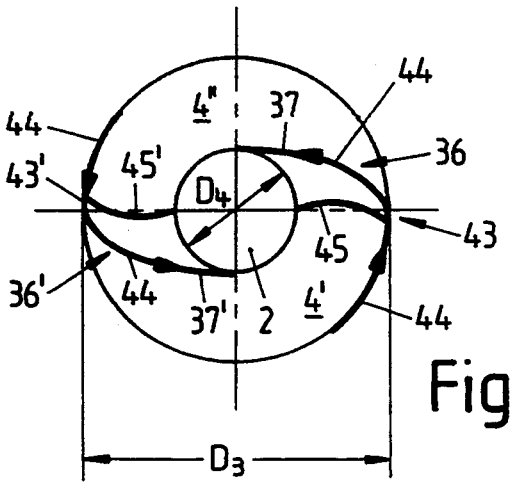
FIGS. 3*a*, 3*b* show a view of the drilling tool according to FIG. 1 (FIG. 3*a*) with a view of the conveyor spiral run-in (FIG. 3*b*)
Figure 3A:
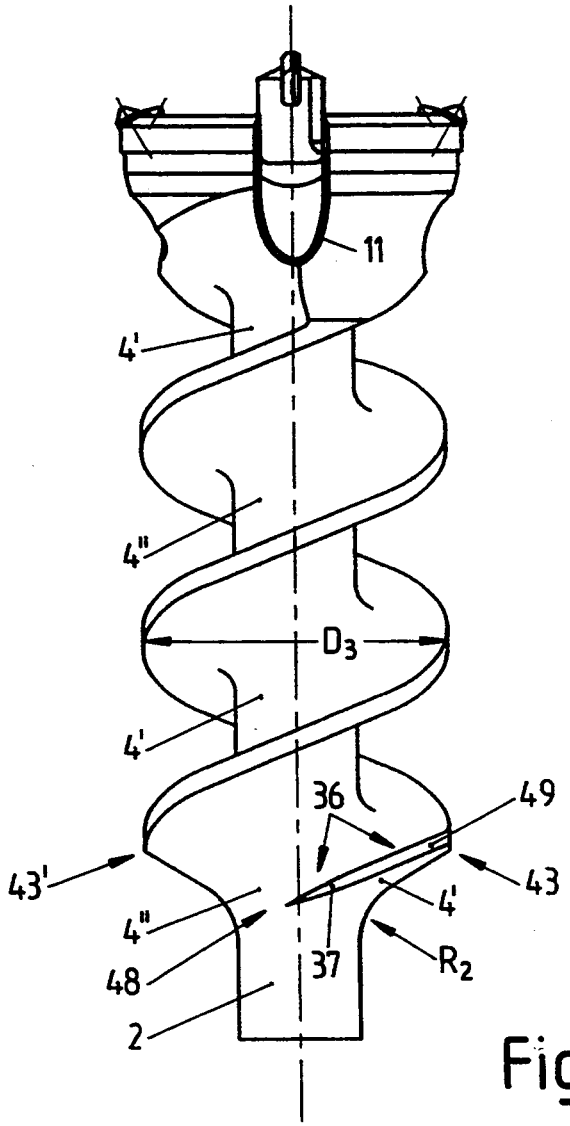

FIG. 3*a* shows once again the view of the drilling tool according to .FIG. 1, FIG. 3*b* the representation of the lower run-in region 36, 36' of the respective conveyor spiral 4', 4''. This transition or run-in region of the conveyor spiral 4, 4' from the drill shank 2 into the spiral region is configured such that the radially outer end 43, 43' leads via an arc-shaped curve 37, 37', tangentially to the outer diameter $D_4$ of the drill shank 2. This arc-shaped or spiral-shaped run-in of the respective conveyor spiral is represented in FIG. 3*b* by the arrows 44. The curve path 45, 45' represented, furthermore, in FIG. 3*b*, is derived from the rounded transition of the respective adjacent conveyor spiral 4', 4''. The surface region situated between the curves 37 45 or 37', 45' runs at the large radius of curvature $R_2$ into the drill shank 2 (FIG. 3*a*), thereby avoiding any stress peaks. By virtue of the heavily rounded run-out 37, 37' of the respective conveyor spiral 4', 4'' into the drill shank 2, the ends of the conveyor spiral are prevented furthermore, from having to be clamped in the wall of a bore.

Figure 4:
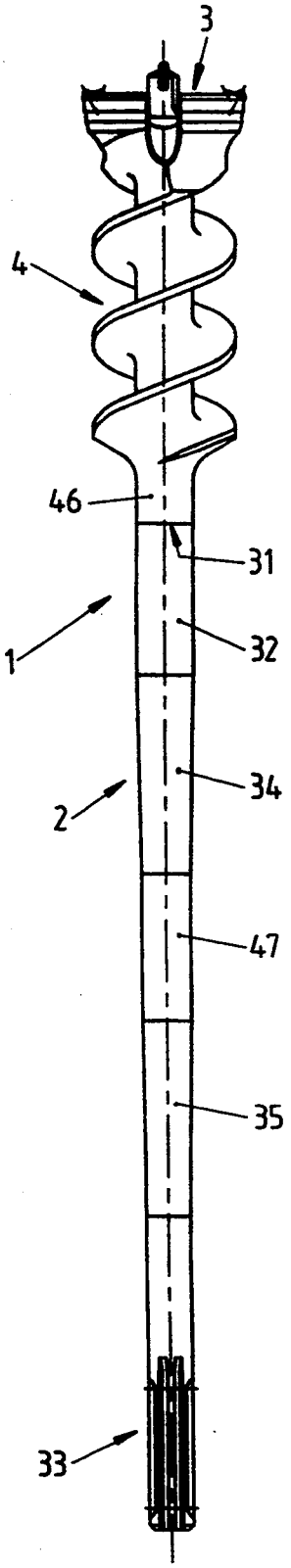
FIG. 4 shows a drilling tool having a conical/cylindrical shank and FIG. 4*a* shows a more detailed representation of the shank according to FIG. 4.
Figure 4A:
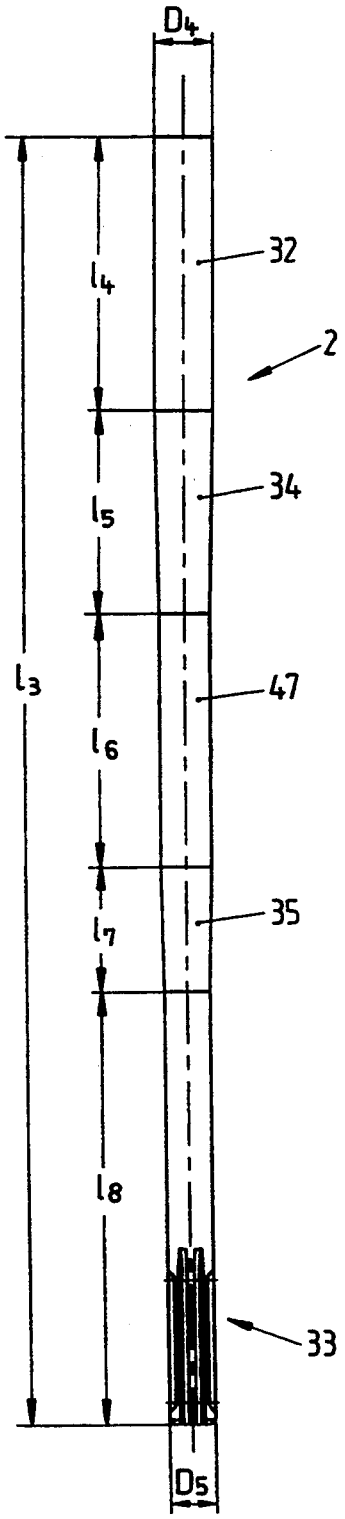

FIG. 4 shows the complete drilling tool with attached drill shank 2, which is represented, once again in isolation in FIG. 4*a*.

The drill shank 2 exhibits a total length $l_3$ generally measuring more than 300 mm. The drill shank 2 is generally Joined together via a friction-welding joint 31, with the cylindrical end 46 beneath the conveyor spiral 4. The diameter $D_4$ at this interface 31 is larger than the diameter $D_5$ of the lower clamping part 33, so that the drill shank is tapered over its length $l_3$.

In the case of known drilling tools, this tapering can be performed by a one-piece, conical structural part or by cylindrical shoulders exhibiting jumps in cross section. Cylindrical shoulders for the tapering of the diameter of the drill shank have the drawback, in relation to a conical construction, that stress peaks can be generated at each jump in diameter due to the percussive strain upon the drilling tool, which strain can lead to increased stressing of the drilling tool. At the individual shoulders, furthermore, due to the impact pulses, shock wave reflections are generated which have an adverse effect upon the tool and, in particular, upon the solidity of the tool. In addition, due to the jumps in cross section, the vibration characteristics of such a tool are negatively affected. These criteria apply more strongly to a drilling tool having a one-piece conveyor spiral, since the weight and the vibration characteristics of the conveyor spiral also have an effect upon the following drill shank.

In a conical construction of the drill shank 2, these drawbacks are not present to this degree. A drill shank of this kind is consequently able to deliver higher drilling capacities for the tools. A drawback with a conical construction of the drill shank is, however, the unfavourable receiving and clamping facilities in respect of friction-welding and the adjustment of the drill shank. In particular where there are different lengths of drill shank, very different angles of taper are produced, which require special clamping Jaws or specific clamping tongs for clamping a conical shank of this kind.

The invention consequently envisages that the drill shank 2 should be shaped in steps from the lower insertion end or clamping part 33 to the upper drilling head connection, the transitions between the steps being constructed conically in each case. By virtue of this construction, the advantage of increased capacity, i.e. the better throughput of the impact pulses and the avoidance of reflections at the shoulders, is achieved. In addition, the shouldered cylindrical construction enables the drill shank to be received and clamped without difficulty, both in the creation of the friction-welding joint 31 and in the adjustment of such a tool. Where there are different lengths of drill shank, the respective regions can in each case be optimally shaped. Measurements have revealed that, by virtue of these measures, considerable increases in capacity can be achieved. In the illustrative embodiment of a drill shank of this kind according to FIG. 4, the drill shank 2 is connected to the conveyor spiral 4 via the friction-welding joint 31, at least the uppermost part 32 having the length $l_4$ being configured as a cylindrical shank part 32 and there being provided, between this cylindrical shank part 32 and the lower clamping part 33 for the prime mover, in particular two conical shank part sections 34, 35 having a length $l_5$ and $l_7$.

The drill shank 2 accordingly comprises, in sections, an upper cylindrical section 32 having the length $l_4$, a following conical section 34 having the length $l_5$, a further cylindrical shank section 47 having the length $l_6$ and a further conical shank section 35 having the length $l_7$, which is adjoined by the clamping part 33 having the length $l_8$. The lengths $l_4$, $l_6$ of the cylindrical shank sections 32, 47 exhibit an axial length, which axial lengths preferably correspond to between two and four times the upper shank diameter $D_4$ in order to acquire a sufficient length for the clamping of this shank part.

By virtue of these measures, an increase in drilling capacity can be obtained by improved transmission of the impact energy from the insertion end 33 towards the drilling head, since, in particular, no reflections of the impact pulse are generated at jumps in the diameter. The drill shank can nevertheless be inserted without difficulty, by its cylindrical pats, into a conventional clamping chuck or jaw chuck or into otherwise conventional clamping devices.

The invention is not limited to the represented and described illustrative embodiment, but also embraces all expert refinements and designs within the framework of the inventive concept.

We claim:

1. A drilling tool for creation of breaches in concrete or masonry, comprising:

a drill shank;

a conveyor spiral having a run-in region at one end merging with said drill shank and an end opposite to said one end;

a carbide-tipped drilling head integrally connected with the opposite end of said conveyor spiral and including radially disposed and circumferentially extending cutting fins and a cavity which emerges as a bore dust run-out in said conveyor spiral, wherein a transition between said drilling head and the opposite end of said conveyor spiral exhibits a circumferential constriction so that all cutting fins have a substantially similar longitudinal cross section and the transition is substantially rotationally symmetrical.

2. The drilling tool according to claim 1, wherein said conveyor spiral is a double-pitched spiral having two dust run out grooves, said drilling head includes four cavities each of which emerge as a bore dust run-out in one of the bore dust grooves of the double pitched conveyor spiral and four cutting fins being separated from one another by a respective one of said cavities and comprising radially disposed, axially extending annular segments, said four cavities including a first pair of opposed cavities each having an oblique run out that is inclined at an angle of approximately 45° with respect to the longitudinal axis of said drilling tool and a second pair of opposed cavities each having a cavity run out that is substantially parallel to said longitudinal axis thereby forming a steep bevel with respect to the double-pitched conveyor spiral.

3. The drilling tool according to claim 1, wherein said drilling head has an outer diameter which is approximately 10% larger than an outer diameter of said conveyor spiral.

4. The drilling tool according to claim 1, wherein said conveyor spiral has an axial length which is at least twice as large as an outer diameter of said drilling head.

5. The drilling tool according to claim 1, wherein the carbide tip of said drilling head is centrally disposed on said drilling head, and wherein said drilling head is pot-shaped and includes a circumferential base which is arched in a semi-circle toward said carbide tip.

6. The drilling tool according to claim 2, wherein each of said annular segments includes a roof-shaped end face having a radially inner bevel and a radially outer bevel, and a carbide cutting stud disposed on at least the radially outer bevel of each said annular segment and pointing radially outwardly.

7. The drilling tool according to claim 6, wherein the radially inner bevels of at least two oppositely disposed annular segments each include a carbide cutting stud pointing radially inwardly.

8. The drilling tool according to claim 2, wherein each of said annular segments includes a roof-shaped end face and further including carbide cutting studs disposed on said roof-shaped end face, with at least some of said carbide cutting studs disposed asymmetrically with respect to the longitudinal axis of said drilling tool.

9. The drilling tool according to claim 5, and further including at least two carbide cutting studs disposed on the circumferential base of said drilling head at different radial distances from the longitudinal axis of the drilling tool thereby presenting a radially inner carbide cutting stud and a radially outer carbide cutting stud.

10. The drilling tool according to claim 9, wherein said at least two carbide cutting studs are disposed asymmetrically with respect to the longitudinal axis of said drilling tool.

11. The drilling tool according to claim 9, wherein the radially outer carbide cutting stud is disposed in a region of said circumferential base which is strengthened after run-out of the conveyor spiral.

12. The drilling tool according to claim 6, wherein each said carbide cutting stud has a center axis that is normal to the respective bevel on which the carbide cutting stud is disposed and which is oriented in a direction that forms an angle of 30° with respect to the longitudinal axis of said drilling tool.

13. The drilling tool according to claim 6, wherein said bevels have a case-hardened surface.

14. The drilling tool according to claim 2, wherein the carbide tip of said drilling head is centrally disposed on said drilling head, said drilling head is pot-shaped and includes a circumferential base which is arched in a semi-circle toward said carbide tip and said circumferential base includes at least one carbide cutting stud disposed in a region adjacent one of said oblique run outs.

15. The drilling tool according to claim 1, wherein said conveyor spiral, in said run-in region and starting from an outer diameter of said conveyor spiral, arcuately approaches and tangentially passes over said drill shank.

16. The drilling tool according to claim 1, wherein said conveyor spiral is connected to said drill shank by a friction-welding joint and said drill shank includes a cylindrical section at least adjacent said run-in region, at least one conical shank section and a cylindrical clamping part for a prime mover, said at least one conical shank section being disposed between said cylindrical section and said cylindrical clamping part.

17. The drilling tool according to claim 16, wherein said drill shank is formed by a succession of drill shank sections including an uppermost cylindrical shank section followed by a first conical shank section, an intermediate cylindrical shank section, and a second conical shank section adjoined by said cylindrical clamping part.

18. The drilling tool according to claim 16, wherein said uppermost cylindrical shank section has a diameter, and said uppermost cylindrical shank section and said intermediate cylindrical shank section each have an axial length which corresponds to about two to four times the diameter of said uppermost cylindrical shank section.

19. The drilling tool according to claim 1, wherein the rotational symmetry of said transition is such that said drilling head exhibits a symmetrical bell shaped structure.

* * * * *